United States Patent [19]

Swersky et al.

[11] 4,231,437

[45] Nov. 4, 1980

[54] COMBINED STABILIZER AND REAMER FOR DRILLING WELL BORES

[75] Inventors: Gerald S. Swersky; Keith J. Mason, both of Edmonton, Canada

[73] Assignee: Christensen, Inc., Salt Lake City, Utah

[21] Appl. No.: 12,667

[22] Filed: Feb. 16, 1979

[51] Int. Cl.[3] ..... E21B 9/24; E21B 17/10; E21C 9/00

[52] U.S. Cl. ..... 175/325; 175/346; 175/408

[58] Field of Search ..... 175/323, 324, 325, 326, 175/344–347, 361–364; 166/241; 308/4 A

[56] References Cited

U.S. PATENT DOCUMENTS

| | | | |
|---|---|---|---|
| 1,844,371 | 2/1932 | Santiago | 175/408 X |
| 1,996,322 | 4/1935 | Carlson | 175/345 X |
| 2,217,592 | 10/1940 | Krick et al. | 175/347 |
| 2,472,749 | 6/1949 | Lake | 175/408 X |
| 2,542,725 | 2/1951 | Stewart et al. | 175/346 X |
| 3,306,381 | 2/1967 | Garrett et al. | 175/346 |
| 3,318,398 | 5/1967 | Owen | 175/323 |
| 4,081,203 | 3/1978 | Fuller | 175/325 X |

*Primary Examiner*—James A. Leppink
*Attorney, Agent, or Firm*—Subkow and Kriegel

[57] ABSTRACT

An upper stabilizer and a lower reamer are mounted on an integral or one-piece body adapter to be connected in a tubular drilling string for drilling well bores.

12 Claims, 6 Drawing Figures

COMBINED STABILIZER AND REAMER FOR DRILLING WELL BORES

The present invention relates to subsurface apparatus for drilling well bores.

Heretofore, well bores have been drilled through use of reamer and stabilizer units mounted on separate bodies which are connected to each other by interengaging box and pin threads. These units are connected at an appropriate location in a tubular drill string, with the upper end of the stabilizer body connected to a drill pipe or drill collar section thereabove by means of box and pin threads, the lower end of the reamer body being connected to a bit, or lower sub, by means of box and pin threads. The stabilizer unit has the purpose of reducing lateral deviation, vibration and wobble of the drill bit, thereby improving the penetration rate of the bit in the well bore, as well as the life of the bit itself. Additionally, the unit has the purpose of stiffening the drill collar to reduce collar deflection and the tendency of the collars in the well bore to tilt, which causes the drill bit to correspondingly tilt and produce an oversized hole which has deviated from the desired drilling direction. The stabilizer also assists in preventing the drill collars from sticking to the wall of the hole.

The reamer unit has the purpose of maintaining the hole diameter within acceptable tolerances, thereby reducing the possibility of the drill string from sticking to the hole wall. It further reduces the amount of reaming required of a new drill bit run into the hole after a previous bit has been removed and replaced by the new bit. The reamer cutters make contact with the hole wall, and also provides a small degree of stabilization.

In actual practice, the reamer unit and the stabilizer unit connected thereto do not achieve the purposes of a reamer and a stabilizer to the desired extent. Lateral deviation, vibration and wobble at the drill bit, and also at the reamer, still takes place, reducing the penetration rate and the lives of the bit and reamer. In addition, the threaded connection provided between the reamer unit and the stabilizer unit contributes to their excess overall length, which still permits the drill bit to deviate, vibrate and wobble. It also increases their manufacturing cost.

By virtue of the present invention, the separate body members of the stabilizer unit and reamer unit are eliminated, the two body members being combined into an integral or single part. This enables the stabilizer components and the reamer components to be placed much closer to each other, thereby enabling the combined unit to be substantially shorter in overall length, and also eliminating the threaded connection heretofore required between the bodies of the stabilizer and reamer units. The amount of material required, as well as machining costs, are reduced, since only a single fishing neck is needed for coaction with fishing tools in the event of difficulty being encountered while the apparatus is in the well bore. Contributing to the reduced material and machining costs is the elimination of the threaded connection between the reamer body and stabilizer body. The elimination of that connection reduces considerably the risk of breakage occurring at that location.

By manufacturing the reamer and stabilizer body portions as a single or integral unit, the interaction between the reamer portion and stabilizer portion are greatly improved, due to such portions operating interdependently with respect to each other.

The cutters of the reamer portion are removable to enable their replacement upon becoming worn. The combined unit embodying the integral or one-piece body member has its parts so arranged that the stabilizer portion and reamer portion can be placed closer together, while still enabling worn reamer cutters to be disassembled from the body portion and a new set of cutters substituted therefor.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the Drawing.

Figure 1:
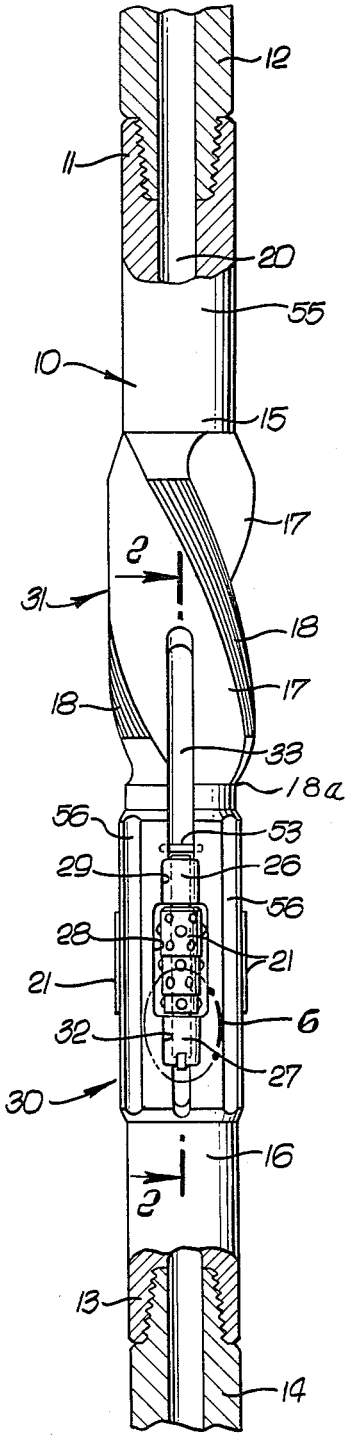
FIG. 1 is a side elevational view, with portions shown in longitudinal section, of a combined stabilizer and reamer embodying the invention.
Figure 2:
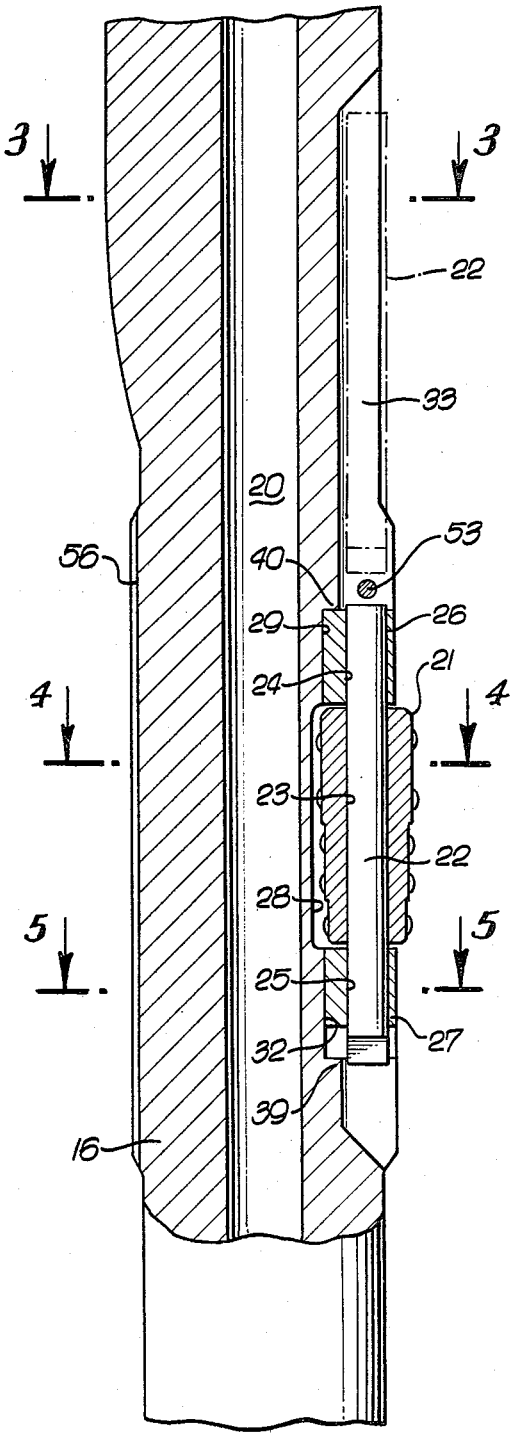
FIG. 2 is an enlarged, fragmentary longitudinal section taken along the line 2—2 on FIG. 1.
Figure 3:
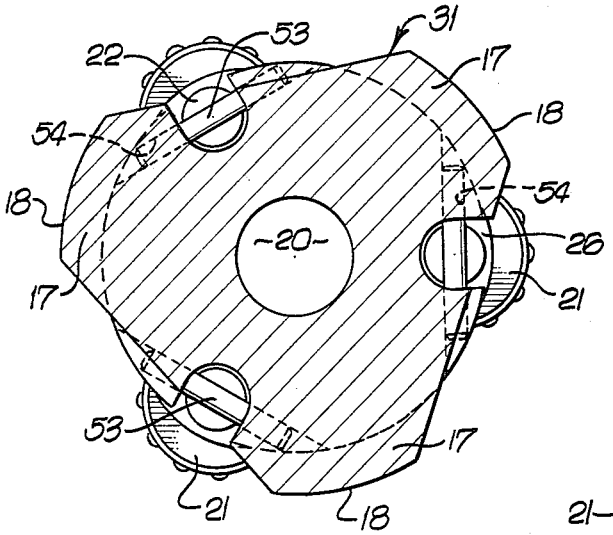
FIG. 3 is a cross-section taken along the line 3—3 on FIG. 2.
Figure 4:
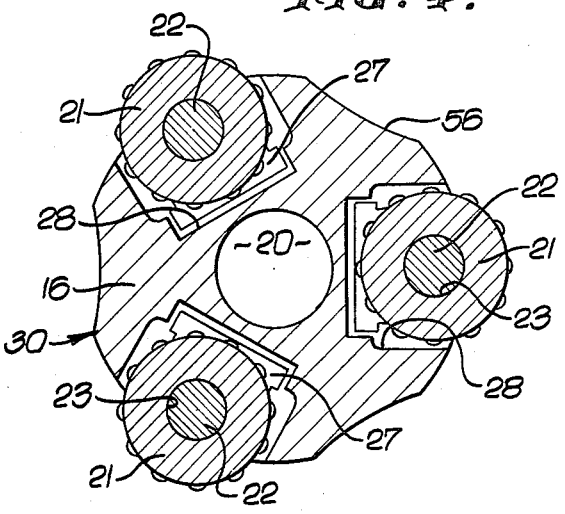
FIG. 4 is a cross-section taken along the line 4—4 on FIG. 2.

As illustrated in the drawings, a combined reamer unit 30 and stabilizer unit 31 are shown having an integral or one-piece body 10 that has an upper threaded box or pin 11 for threaded attachment to the lower end of an adjacent upper drill collar 12, and a lower threaded box or pin 13 for threaded connection to a lower drill bit 14 or to a collar member, which, in turn, is threadedly connected to the lower drill bit. The tubular body has a fluid passge 20 therethrough and includes an upper stabilizer body section 15 and a lower reamer body section 16, the two sections being integral with one another. The upper section has circumferentially spaced elongate stabilizer pads 17, such as spiral pads, integrally secured thereto, which have their outer surfaces 18 provided with wear resistant material of a known type, such as sintered tungsten carbide members. The outer surfaces of the pad lie on a cylinder having substantially the same diameter as the diameter of the hole being drilled by the lower reamer unit 30. The lower end 18*a* of the pad adjoins the upper end of the reamer section 16. The stabilizer pads will engage the wall of the bore hole for the purpose of maintaining the stabilizer and the reamer centered in the hole.

Circumferentially spaced reamer cutters 21 are carried by the reamer body section 16. As shown, each cutter forms part of a reamer assembly including a longitudinal shaft 22 extending through a companion bore 23 through the cutter and projecting through corresponding bores 24, 25 in an upper reamer block 26 and a lower reamer block 27 disposed at opposite ends of the reamer cutter. The cutter, itself, is disposed in a central body slot 28 which ends at upper and lower adjacent body slots 29, 32 receiving the upper and lower reamer blocks 26, 27. The upper slot 29 communicates with an elongate access slot 33 aligned with the shaft 22 and extending upwardly into the stabilizer body section 15 between a pair of stabilizer pads 17 to an extent slightly greater than the length of the shaft, to permit the shaft to be removed in an upward direction completely from the bearing blocks 26, 27 and cutter 21, as well as to enable the shaft to be placed in the access slot 33 and then moved downwardly through the upper block 26, cutter 21 and lower block 27 to secure the cutter in appropriate position with respect to the reamer body section.

Figure 5:
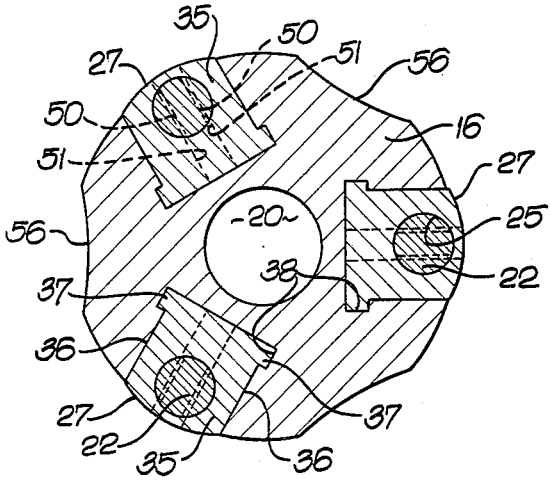
FIG. 5 is a cross-section taken along the line 5—5 on FIG. 2.

Each lower block is T-shaped (FIG. 5), including a main portion 35 which has outer side surfaces 36, and outwardly directed tongues 37 received within companion grooves 38 in the lower body section 16. The lower block comes to rest against an upwardly facing body shoulder 39 to limit downward movement of the block in the body section 16. The upper block 26 is similar to the lower block, its upward movement when assembled in the body being limited by its engagement with a downwardly facing body shoulder 40.

The lower block and upper block are mounted in place before the shaft 22 and reamer cutter 21 are to be assembled, by placing each block radially within the intermediate slot 28, which is wider than the distance across the block tongues 37, the lower block then being shifted longitudinally into the lower slot 32 with the tongues 37 sliding within their companion grooves 38, until the lower end of the lower block engages the stop shoulder 39 on the body section. The shape of the upper block 26 is essentially the same as the lower block, the upper reamer block being inserted into the intermediate slot 28 and then shifted longitudinally in an upward direction until its tongues 37 slide upwardly into the companion grooves 38 of the upper slot, the upper block coming to rest by its upper end engaging the downwardly facing shoulder 40 of the reamer body section.

Figure 6:
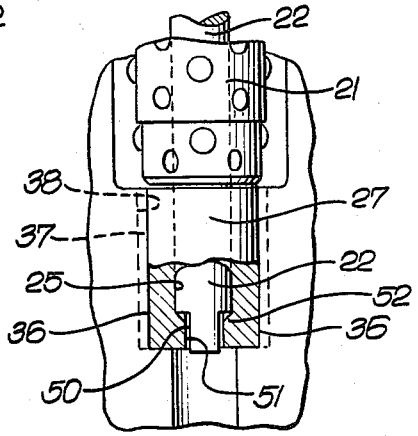
FIG. 6 is an enlarged, side-elevational view, with a part shown in section, of the portion of the apparatus designated by the line 6 on FIG. 1.

A cylindrical reamer cutter 21 is then inserted into the central slot 28 between the upper and lower blocks, whereupon the shaft 22 is placed in the access slot 33 and shifted downwardly through the aligned bores 24, 23, 25 of the upper block 26, cutter 21 and lower block 27. The lowermost portion of the shaft has parallel flats 50 formed thereon for reception between companion flat portions 51 of the lower reaming block, as shown most clearly in FIG. 6, to prevent rotation of the shaft, the shaft adjacent to the flat portions engaging a companion stop shoulder 52 on the lower block to limit further downward movement of the shaft with respect to the reamer body section 16.

With the reamer blocks, cutter and shaft assembled in position, the shaft is prevented from removal from its assembled position by a transverse retainer pin 53 extending across the upper end of the shaft and the access slot 33 into transverse bores 54 formed in the reamer body section, the pin being suitably secured to the reamer body section.

After the stabilizer and reamer apparatus has been withdrawn from the well bore, the cutters 21 can be removed by first removing the retainer pins 53 and then shifting the shafts upwardly out of the lower reamer blocks, cutters, and upper blocks, each shaft 22 passing freely into its associated access slot 33, permitting the cutters to be moved sideways out of its recess and completely from the body section.

It is to be noted that there is no threaded connection provided between the stabilizer 31 and the reamer 30, which enables the section 15, 16 to be placed close to one another. Moreover, the provision of the access slots 33 in the stabilizer body section utilizes a portion of a stabilizer for effecting removal and insertion of each shaft with respect to the blocks and cutter. In addition, the absence of any threaded connection between the stabilizer and reamer enables a single fishing neck 55 to be provided on the apparatus, which will be the region below the upper threaded box or pin 11. It is unnecessary to provide any additional length between the stabilizer and reamer for another fishing neck, in the event the apparatus becomes stuck in the well bore.

The reamer body section is provided with circumferentially spaced fluid courses 56 between the reamer cutters through which circulating fluid and cuttings can pass upwardly for continued upward movement through the spaces provided between the stabilizer pads 17, facilitating the movement of the fluid and cuttings past the reamer and stabilizer unit.

The adjacency of the stabilizer unit and reamer unit to one another shortens the overall length of the apparatus, the two units mutually assisting one another in centering the reamer unit and stabilizer unit in the well bore, the two units being incapable of deflecting with respect to each other and thereby eliminating the tendency of the reamer to tilt and wobble in the well, which is conductive to the drilling of an undesired oversize and spiral hole.

We claim:

1. Stabilizer and reamer apparatus for drilling a well bore, comprising a one-piece body having a fluid passage therethrough, upper coupling means and lower coupling means at the upper end portion and lower end portion, respectively, of said body for securing said body in a tubular drill string, said body including an upper stabilizer section and a lower reamer section adjoining said stabilizer section, elongate circumferentially spaced stabilizer pads secured to said stabilizer section against movement with respect thereto to center said body in the well bore, the lower ends of said pads adjoining the upper end of said reamer section, and circumferentially spaced reamer cutter means carried by said lower reamer section for reaming the well bore.

2. Apparatus as defined in claim 1; said stabilizer pads being rigid and rigidly secured to said stabilizer section.

3. Apparatus as defined in claim 2; the outer surfaces of said pads conforming in effective diameter to the diameter of the well bore drilled by said reamer cutter means.

4. Apparatus as defined in claim 1; said reamer cutter means comprising roller cutters adapted to ream the surrounding wall of the well bore.

5. Apparatus as defined in claim 4; and means mounting said roller cutters for rotation about axes substantially parallel to the axis of said body.

6. Apparatus as defined in claim 3; said reamer cutter means comprising roller cutters adapted to ream the surrounding wall of the well bore.

7. Apparatus as defined in claim 6; and means mounting said roller cutters for rotation about axes substantially parallel to the axis of said body.

8. Apparatus as defined in claim 1; each of said reamer cutter means comprising a roller cutter, a shaft extending through said cutter, means at opposite end portions of said cutter for supporting said shaft on said reamer section, said stabilizer section having slot means into which said shaft can be moved lengthwise from said supporting means and roller cutter to effect removal of said shaft from said reamer section and stabilizer section.

9. Apparatus as defined in claim 8; said supporting means comprising blocks secured to said reamer section and into and from which said shaft can be moved lengthwise of said reamer section into said slot means.

10. Apparatus as defined in claim 9; and retainer means extending across an end of each shaft to prevent removal of said shaft from said blocks and roller cutter.

11. Stabilizer and reamer apparatus for drilling a well bore, comprising a one-piece body having a fluid passage therethrough, upper coupling means and lower coupling means at the upper end portion and lower end portion, respectively, of said body for securing said body in a tubular drill string, said body including an upper stabilizer section and a lower reamer section adjacent to said stabilizer section, elongate circumferentially spaced stabilizer pads secured to said stabilizer section against movement with respect thereto to center said body in the well bore, the lower ends of said pads terminating adjacent to the upper end of said reamer section, circumferentially spaced reamer cutter means carried by said lower reamer section for reaming the well bore, each of said reamer cutter means comprising a roller cutter, a shaft extending through said cutter, means at opposite end portions of said cutter for supporting said shaft on said reamer section, said stabilizer section having slot means into which said shaft can be moved lengthwise from said supporting means and roller cutter to effect removal of said shaft from said reamer section and stabilizer section, said slot means being located in the interior of said stabilizer section between said pads.

12. Stabilizer and reamer apparatus for drilling a well bore, comprising a one-piece body having a fluid passage therethrough, upper coupling means and lower coupling means at the upper end portion and lower end portion, respectively, of said body for securing said body in a tubular drill string, said body including an upper stabilizer section and a lower reamer section adjoining said stabilizer section, elongate circumferentially spaced stabilizer pads secured to said stabilizer section against movement with respect thereto to center said body in the well bore, the lower ends of said pads adjoining the upper end of said reamer section, circumferentially spaced reamer cutter means carried by said lower reamer section for reaming the well bore, each of said reamer cutter means comprising a cutter, a longitudinal member extending along said cutter to retain said cutter on said lower reamer section, means for supporting said longitudinal member on said reamer section, said stabilizer section having slot means into which said longitudinal member can be moved lengthwise from said supporting means and cutter to effect removal of said longitudinal member from said reamer section and stabilizer section, said slot means being located in the interior of said stabilizer section between said pads.

* * * * *